US007757321B2

(12) United States Patent
Calvert

(10) Patent No.: US 7,757,321 B2
(45) Date of Patent: Jul. 20, 2010

(54) MODULAR HOOK AND LOOP ATTACHMENT CUSHIONS

(76) Inventor: Nathaniel Calvert, 3102 Crescent La. NW., P.O. Box 7104, Rochester, MN (US) 55903-7104

( * ) Notice: Subject to any disclaimer, the term of this patent is extended or adjusted under 35 U.S.C. 154(b) by 0 days.

(21) Appl. No.: 12/231,722

(22) Filed: Sep. 5, 2008

(65) Prior Publication Data

US 2010/0058540 A1 Mar. 11, 2010

(51) Int. Cl.
*A47C 20/00* (2006.01)
*A43B 21/32* (2006.01)
*B43L 15/00* (2006.01)

(52) U.S. Cl. ..... 5/657; 5/922; 5/652; 248/118.1; 248/345.1; 36/37; 36/71; 297/219.1

(58) Field of Classification Search ..... 5/411, 5/723, 652, 653, 657, 922; 297/219.1, DIG. 6; 248/118.1, 345.1, 118, 205.2; 24/306, 442, 24/445, 452; 36/37, 71; 2/908
See application file for complete search history.

(56) References Cited

U.S. PATENT DOCUMENTS 3,542,421 A * 11/1970 Ambrose ..... 297/230.12
5,018,790 A * 5/1991 Jay ..... 297/452.26
5,208,084 A * 5/1993 Rutz ..... 428/40.1
5,367,730 A * 11/1994 Sher ..... 5/655
5,803,416 A * 9/1998 Hanson et al. ..... 248/118
6,823,543 B2 * 11/2004 Diak/Ghanem ..... 5/496
6,877,176 B2 * 4/2005 Houghteling ..... 5/655
7,093,898 B2 * 8/2006 Ladron De Guevara .. 297/284.6
7,210,250 B2 * 5/2007 Gallegos ..... 36/44

* cited by examiner

*Primary Examiner*—Michael Trettel
(74) *Attorney, Agent, or Firm*—D. L. Tschida

(57) ABSTRACT

A system of modular, detachable cushions having surfaces containing hook and/or loop fasteners that fasten to mating loop, open weave or hook surfaces to define adjustable, conformal contoured support surfaces at user contact surfaces and appliances producing fatigue and/or abrasion (e.g. automotive seats, chairs, compartment walls, desks, footwear, helmets, tools etc.). The cushions can include air, elastomer, fabric, fiber, foam, liquid, gel, and/or rubber cushioning materials or combinations thereof arranged in envelopes, pads, cavities or tiered assemblies. The cushions include surfaces fitted with one or more layers of cushioning materials or envelopes of cushioning material and one or more regions of fastener materials that mate with interconnecting fasteners at the contact surface or appliance. The cushions can be selectively arrayed about the contact surface or appliance and may be selectively combined and/or layered and/or overlapped onto each other at user specific locations to tailor the cushioning contour.

11 Claims, 8 Drawing Sheets

MODULAR HOOK AND LOOP ATTACHMENT CUSHIONS

BACKGROUND OF THE INVENTION

The present invention relates to cushions, and in particular to modular cushions, including a cushioning material and/or envelopes filled with a pliable cushioning material and having surfaces supporting mating fastener material (e.g. "hook" and "loop") to secure the cushion(s) to a fatigue or abrasion inducing surface, appliance or another cushion assembly in a suitable layered and/or arrayed configuration to define a preferred contour.

A wide variety of circumstances exist where personal comfort is enhanced with the placement of a cushioning material or device between the body and a contacting appliance. The cushioning can reduce fatigue at the points of contact and mitigate a wide variety of physical symptoms including skin ulcerations, nerve damage, including carpal tunnel syndrome, and bone and joint complications among other discomfiture.

Different types of cushions or padding are frequently used in the different cushioned apparatuses to reduce contact trauma that occurs when an item is in personal physical contact for extended periods of time. This contact can include but is not limited to contact associated with sitting, reclining, walking, standing, running, gripping, and/or wearing specific garments (e.g. helmets and hats, etc.).

Wide varieties of cushioning and comfort enhancing devices have been developed for wide ranging industries (e.g. automobile, airline, trucking, sporting, medical, office supply, and footwear, among others). Numerous constructions of comfort-enhancing apparatuses (e.g. seat and lumbar cushions, floor mats, wrist/arm rests, padded gloves, padded clothing, padded headwear, saddle pads, bicycle seats, care seat, etc.) have particularly been developed to alleviate physical discomfiture. Some of these assemblies include fastening devices such as straps, tape or the like to secure a cushion fixture but which limit dynamic attachment and reattachment to anchoring locations. Most of these assemblies don't permit adjustments to fit personal body characteristics and/or personal comfort desires peculiar to specific contact areas and ranges of motion at the contact points. Most adhesives also fail over time due to the collection of dirt. Mechanical fasteners and straps are also bulky and over time create additional deleterious contact points.

Due to inherent differences in size and stature of each user, a fixed comfort configuration does not work for the masses. It is therefore desired that any cushioning device accommodate personal tailoring adjustments to fit personal preference, body size etc. A dynamically reconfigurable cushioning assembly is particularly desired that mounts to any desired surface or appliance and that allows a user to change/modify the cushioning device by dynamically adding to and or removing from the cushioning device; cushioning material. The cushioning assembly should also permit reconfiguration in real time by a layperson without the use of special tools.

Existing assemblies also typically don't accommodate time variables, that is, what is comfortable at one point in time may become uncomfortable over extended usage. Therefore it is desirable that any comfort enhancing device permit dynamic adjustment over time to permit the removal and/or changing of the location and/or configuration of the cushioning apparatus based on personal desires, range of motion, duration of contact, etc.

The present comfort-enhancing apparatuses were developed to provide a hook and loop fastener interface at a personally defined attachment position that permits attachment of a cushioning or comfort-enhancing apparatus to any surface or appliance at any user contact position outfitted with a mating fastener interface. The fastener interface can comprise any interconnecting fastener mechanism, although a "hook" and "loop" attachment interface is the preferred attachment interface.

The preferred contact area, whether it is a wall, user support or personal appliance, should normally contain the loop interface of the hook and loop fastener apparatus. The "loop" interface material is gentler to touch and does not snag adjacent materials. The loop interface can comprise discrete or integral pieces or surfaces of loop-type fastener material or various open-weave materials.

Correspondingly, the hook fastener interface can be discretely mounted or integrally formed to a mating surface of the comfort-enhancing apparatus, substrate or an envelope apparatus that contains a suitable cushioning structure. The comfort-enhancing apparatus can thereby be secured alone or in combination to define a tailored, multi-dimensional assembly anywhere at a desired contact surface and/or about the abrading appliance. The comfort-enhancing portion of the assembly can include among other features, fiber padding, soft durometer rubbery materials, elastomers, foams, liquids, air, gels, semi-solid materials, alone, in pockets/envelopes or in various combinations and desired durometer.

A preferred fastener of material is a micro fiber, ultra thin, "hook" and "loop" fabric described at U.S. Pat. No. 7,231,789. This ultra thin, "snapping" fabric provides properties that are not available in the traditional "hook" and "loop" fastener materials. These properties include but are not limited to an ability to be attached directly to a cushioning device or a fabric material worn next to the body. The ultra thin material also has the property that it can be integrated with wicking materials to assist in the movement of perspiration away from the body while allowing air to flow across and through the cushioning envelopes.

SUMMARY OF THE INVENTION

It is a primary object of the invention to provide a cushioning assembly having a surface supporting a fastener interface that attaches to a surface bearing a mating fastener interface at a physical contact surface of a user contact surface or a user appliance that permit the rearrangement and/or stacking of cushioning devices to user preferred arrangements or contoured arrays.

It is a further object of the invention to provide a cushioning assembly having a surface supporting a hook material that attaches to a surface (e.g. wall, user support or worn appliance) bearing a mating loop fastener material or an open weave material.

It is further object of the invention to provide cushioning assemblies of various sizes, shapes and materials having an integral or discrete hook fastener surface that can be layered or arrayed about a fatigue or abrasion inducing surface of an appliance and that supports an integral or discrete loop fastener surface.

It is further object of the invention to provide a cushioning assembly wherein one surface supports a loop fastener interface and another surface supports a hook fastener interface in collaboration with an associated cushioning/padding assembly.

It is further object of the invention to provide cushioning assemblies having surfaces covered with an open weave material and surfaces containing integral and/or attached hook type fastening materials.

It is further object of the invention to provide cushioning assemblies having integral or attached hook type fastening material and cushion/pads containing materials that can include among other materials, fiber padding, rubber, soft or low durometer rubbery material, elastomers, foams, pads/pockets/envelopes of soft rubber, liquids, air or gels, and/or semi-solid materials, alone or in combination.

It is further object of the invention to provide a layered cushioning assembly having layers of hook and loop fastener materials secured to laminated fastener layers (e.g. adhesive, tape etc.).

It is further object of the invention to provide a cushioning assembly having hook and loop fastener materials secured to an adjacent cushioning assembly including, for example, a liquid, gelatinous or air cushioning material.

The foregoing objects, advantages and distinctions of the invention are obtained in several representative presently preferred constructions of modular cushions that can be secured to user worn or support appliances alone or in desired arrays. The modular cushioning devices provide substrates having one or more layers of cushioning material or envelope(s) containing relatively soft cushioning material that further support exposed surfaces containing hook and loop fastener material. The hook material is adapted to secure the cushion(s) to any mating loop material or loosely woven fabric surface at the appliance or at another cushion. The invention finds application in combination with a wide variety of user contact surfaces or user support appliances where physical contact occurs with the user including among other applications, beds, chairs, clothing, footwear, gloves, helmets, kneepads, office equipment, seats, saddles, operator compartments (e.g. vehicles, equipment) or structural surfaces (e.g. walls, floors etc.).

Still other objects, advantages, distinctions, constructions and combinations of individual features of the invention will become more apparent from the following description with respect to the appended drawings. Similar components and assemblies are referred to in the various drawings with similar alphanumeric reference characters. The description to each combination should not be literally construed in limitation of the invention. Rather, the invention should be interpreted within the broad scope of the further appended claims.

BRIEF DESCRIPTION OF THE DRAWINGS

Several figures are provided which disclose presently preferred constructions, combinations or assemblies of the invention for some of the most common applications of the invention, among other possible configurations and applications, and comprise the following.

DESCRIPTION OF THE PREFERRED EMBODIMENT

Figure 1:
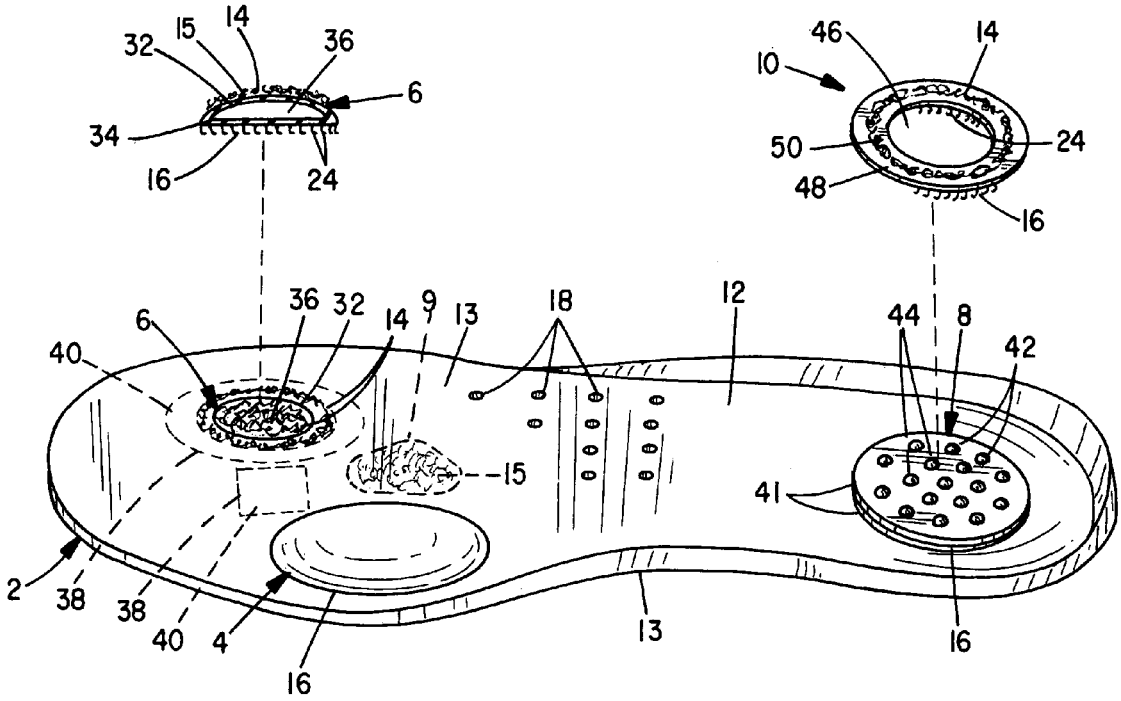
FIG. 1 is a perspective view to a molded foam insole liner having a laminated fabric cover and supporting internal gel/liquid cushioned areas, a detachable, foam/gel support pad and a detachable, foam/rubber/gel heel pad.
Figure 2:
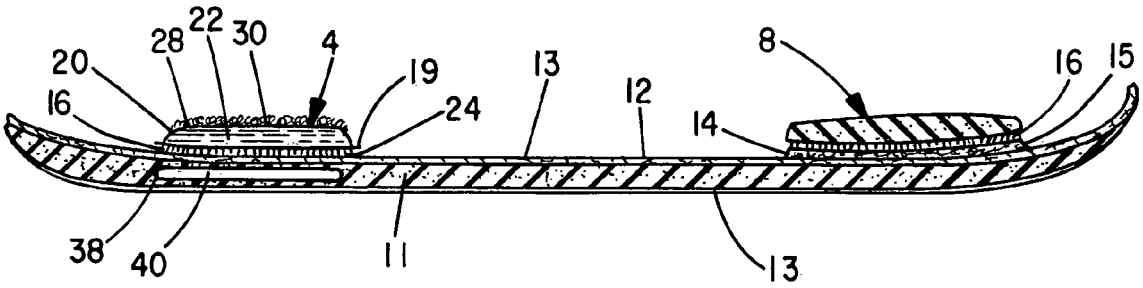
FIG. 2 is a longitudinal cross section view of FIG. 1.

Referring to FIGS. 1 and 2 perspective and cross section views are shown to a representative insole assembly 2 fitted with several detachable cushions 4, 6, 8 and 10. The extra cushion 6 can be mounted to the lower cushion 6 as desired to provide a desired contour and/or increase the thickness of the cushioning. The cushion 10 can be mounted to the heel in lieu of the cushion 8. The cushions 4, 6, 8 and 10 typically fasten to the insole 2 although can fasten to other cushions 4, 6, 8 or 10 outfitted with a mating fastener material. The durometer, pliability, resilience and other cushioning attributes of the various cushions of the invention can be adjusted as desired to accommodate the user and each specific application.

The insole 2 is presently molded from a relatively stiff, high durometer material 11 (e.g. polyurethane foam) although can be formed from other materials that exhibit a suitable durometer to support the load without premature flattening or degradation of the support material in critical regions such as adjacent the heel, inside or outside medial (i.e. ball) regions or at the ankle region. Also shown are several alternative arrangements of internal cushioning pockets, envelopes or pads that can contain suitable rubber, liquid, gel, and/or air cushioning materials.

The upper or sole contact surface 12 of the insole is covered with a durable open weave cover material 13. The cover material 13 overlies the foam 11 on at least the upper surface of the insole 2. The bottom of the insole 2 can be covered or not as desired. As depicted, a bottom cover material 13 of suitable weave is included.

Selected regions of the sole contact surface 12 can also be fitted with patches of "loop" type fastener material 14 that is defined by tufts of looped filaments 15 or open weave material. The loop material 14 is attached by lamination or sewing to the foam 11 and/or cover material 13 or by insert molding, chemical, thermal, sonic or other bonding techniques to the foam 11. Patches 9 of the looped filaments 15 may also be integrally formed or insert molded into the foam 11 and exposed through the cover material 13.

The medial cushion 4 is mounted to a patch of looped material 14 that is attached to the foam 11 and the heel cushion 8 is mounted to a patch of looped material 14 that is attached to the cover material 13. In either instance, the loop fastener patches 14 provide a fastener interface for a mating patch of "hook" type fastener material 16 fitted to the cushions 4, 6, 8 and 10 and whereby the cushions 4, 6, 8 and 10 are secured to the insole 2. Apertures 18 are also selectively formed into the insole 2 to ventilate the insole 2.

The detachable medial cushion 4 can also be secured directly to the cover liner 13 as shown at FIG. 2 beneath the "ball of the foot" with a patch of hook type fastener material 16. The material 16 is bonded in a suitable fashion such as with an adhesive layer 19 (e.g. tape or substrate bound adhesive or heat or chemical welded adhesive or the like) to a solid cushion material or an envelope 20 that contains a soft cushioning material such as air, gel, liquid or a semi-solid rubbery filler 22. Hook shaped fibers or cilia 24 project from the adhesive layer 19 of the fastener material 16 and grip the open weave cover material 13 to retain the cushion 4 to the insole 2.

The adhesive layer 19 if constructed with a substrate can form one encapsulating layer of the envelope 20 or can be independently bonded to the envelope 20. Depending upon the cushioning material, the other encapsulating surface of the envelope 20 is constructed from a fabric or porous material or a liquid or air impermeable layer 28. The layer 28 can be formed to support a bonded layer of "loop" material 30 or can be fabricated with integral looped fibers 15 that interact with the hook fibers 24 of another cushion 4 placed upon the lower cushion 4.

One or more detachable toe or bunion cushions 6 are secured to the open weave liner cover material 13 or each other with other bonded layers of hook material 16. The lower cushion 6 mounts beneath the toes or at an outside medial region of the foot. The cushion 6 is defined by liquid impermeable layers 32 and 34 that form an envelope around a contained liquid, gel, air or soft, gelatinous, semi-solid or fiber cushioning material 36. A second cushion 6 is also shown that can be attached to the loop material 14 fitted to the upper surface of the lower cushion 6 as desired to increase the lateral and/or vertical profile of the combined pair of cushions 6.

The insole 2 may also include one or more regions defined by internal cavities 38 of preferred shape that are provided about the insole 2. The cavities 38 are filled with a suitable cushioning material 40 similar to that used in the external cushions 4-10 (e.g. air or a solid, semi-solid, gel or liquid form material) and are normally covered over with the liner 13. One or more other layers of impermeable material can also be incorporated into the cavities 38 to prevent migration of the material 36. The cavity(s) 38 can also be exposed through the liner 13 and covered over with loop fastener material 14. The cavity(s) 38 can be located medially between the cushions 4 and 6 or anywhere over the surface of the insole liner 4.

Mounted to the insole 2 in the region of the heel is the heel cushion 8. The cushion 8 is defined by one or more layers 41 of solid cushioning material of suitable durometer(s) (e.g. foam, sponge rubber etc.) formed and arranged to a preferred contoured configuration (e.g. a circle or other contour that appropriately supports the heel). Raised dimples 42 and/or apertures 44 are formed at the cushion 8 to wick away moisture and vent the heel. The cushion 8 is attached to the cover liner 13 with a patch of hook material 16 secured to the bottom surface of the cushion 8.

In lieu of the solid material cushion 8, an alternative patch type, annular cushion 10 can be secured to the heel or any other desired surface region of the insole 2. The cushion 10 provides for a large open center space 46 that is surrounded by a ring-shaped envelope 48 filled with a gel 50. A hook material 16 is bonded to the bottom of the cushion 10 and secures the cushion 10 to the liner 13. A loop material 14 can be fitted to adorn the top of the cushion 10. The configuration and thickness of the cushion can be varied to other forms and thicknesses and/or can contain other cushioning materials or compartments filled with different materials to exhibit a surface that conforms to the irregular shape of the heel or other surface of the foot.

Figure 3:
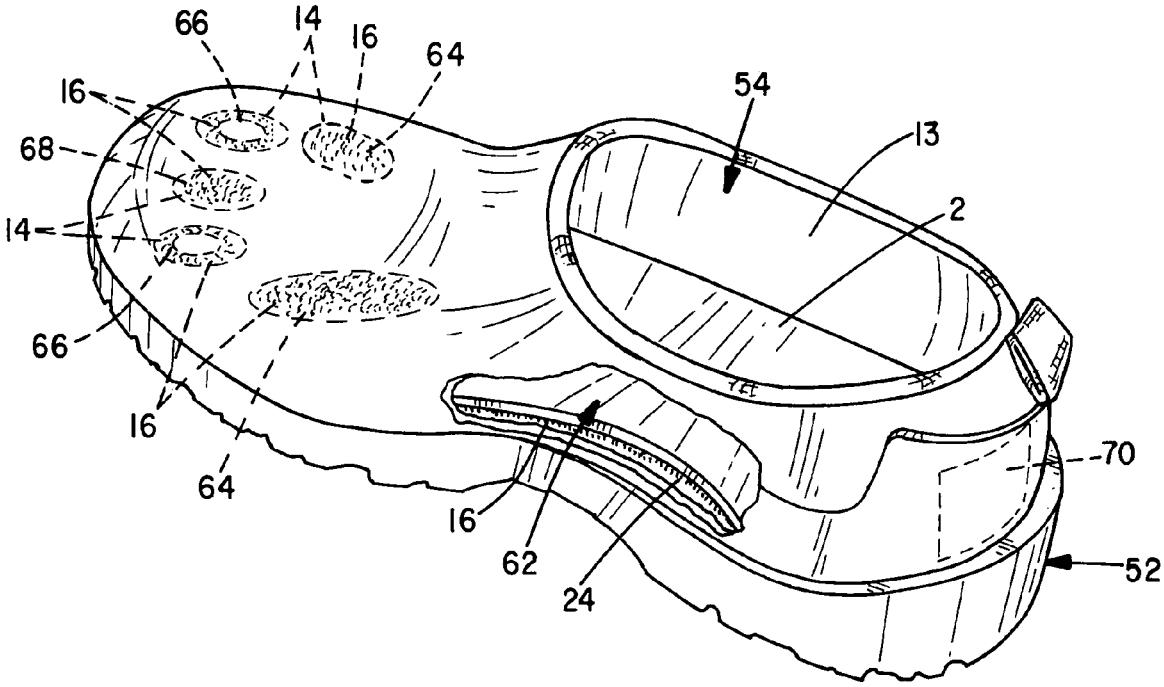
FIG. 3 is a perspective view of a shoe shown in partial cutaway and depicting attached arch support, toe, bunion, heel and foot pads secured to a fabric shoe liner and/or a fabric covered, molded foam insole insert.

Appreciating the advantages of the insole cushions of FIGS. 1 and 2, FIG. 3 depicts a perspective view to a shoe 52 that is lined with an open weave fabric liner 54. The shoe 52 can include the insole 2 and any of the cushions 4, 6, 8, 10 or 38 or combinations of the cushions 4, 6, 8, 10 or 38 that may be appropriate. The material of the liner 54 is similar to the open weave fabric 13 or can comprise a looped fleece material and to which the cushions 4, 6, 8, 10 or 38 can be fitted as appropriate. Shown in hidden view and partial cutaway at the shoe 52 are several cushions 62, 64, 66, 68 and/or 70 that can be attached to the liner material 13 or any of the cushions fitted to the shoe 52 that have an exposed surface outfitted with an open weave or looped material 14.

Mounted to the liner 54 at the instep region of the shoe 52 is a molded foam arch support 62. The support 62 is fabricated from high density foam or other cushioning material of suitable durometer, pliability, resilience etc. The shape of the support 62 can be formed to accommodate a variety of arch configurations and heights. A hook material 16 is bonded to the bottom of the arch support 62 and the depending hook cilia fibers 24 secure the support 62 to the liner material 13.

Arrayed to the liner 54 above the medial region of the foot and adjacent the toes are annular or pads or cushions 64 that contact the upper surfaces of the foot. Other annular or solid cushioning pads 66 and 68 are mounted to contact the toes. The pad 64 provides a single layer of a rubber, foam or other solid material that is affixed to the shoe liner 54 by an attached layer of hook material 16. A layer of loop material 14 is attached to the surface of the pads 64, 66 and 68 that contact the foot.

The pads 66 and 68 are formed as layered assemblies of a base hook material substrate 16, one or more laminated solid foam/rubber cushioning layers and an open weave fabric or loop material 14 cover layer. The cushioning pads 66 and 68 are secured with the patches of hook material 16 to the liner 54. The open weave or loop material 14 cover material secured to the foot contacting surfaces of the cushions 64, 66 and 68 is mounted to contact the foot or permit other cushions 64, 66 and/or 68 to be stacked to the cushions attached to the liner 54.

The thickness of each layer of the pads 64, 66 and/or 68 can thus be sized as desired or several pads 64, 66 and/or 68 can be stacked onto each other to provide a preferred, contoured cushioning profile. Generally, however, the larger size cushion 64 is formed to cushion the upper surface of the foot from abrasion and the smaller cushions 66 and 68 are sized and mounted to protect the toes. Although a solid cushioning material is presently preferred at the pads 64, 66 and 68, the pads can be constructed as envelopes containing air, liquid, gel or other pliable cushioning material.

An additional foam cushion 70 of similar construction to the pads 64, 66 and 68 is located and fastened with a patch of hook fastener material 16 to protect the back of the heel. The cushion 70 can also be extended or bent to mount beneath the heel in a manner similar to the cushions 8 and 10. The cushioning pads 64, 66, 68 and 70 may also provide a cushioning layer containing envelopes combining solid materials with pockets of air, liquid, gel or other semi-solid material. Collectively, the cushioning pads 62, 64, 66, 68 and 70 protect the bottom and upper surfaces of the foot and can be attached anywhere to the liner 13 of the insole 2 or the shoe liner 54 or to the fabric/loop material cover surfaces 14 provided at the pads 62, 64, 66, 68 and 70.

Figure 4:
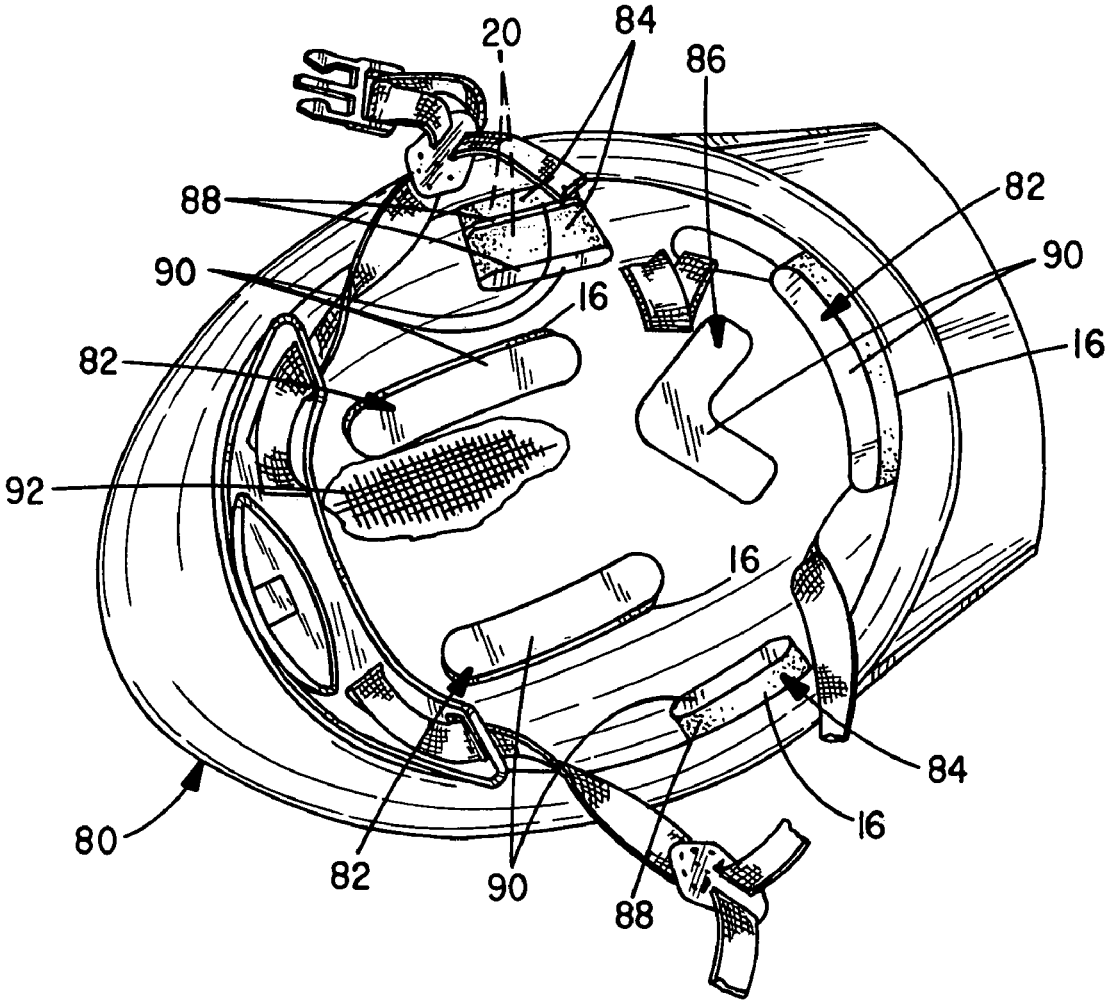
FIG. 4 is a perspective view to a fabric lined bicycling helmet with several attached and/or layered sizing and cushioning pads.

As with shoes, the cushions of the subject invention can be used to cushion other portions of the anatomy that contact other appliances and devices. FIG. 4 depicts a bicycle helmet 80 that is outfitted with several cushioning pads 82, 84 and 86 of different shapes and constructions. Each of the pads 82, 84 and 86 contains a base layer of hook material 16, a foam cushioning layer 88 and an open weave fabric cover layer 90. The hook material layers 16 are secured to an open weave fabric or loop liner material 92 that is laminated to the inside of the helmet 80 or the fabric cover layer 90 of an adjacent cushioning pad 82, 84 or 86.

Although a foam material is presently preferred at the cushioning layer 88, the cushioning layer 88 can comprise any of the various materials or envelope assemblies of air, liquid, gel or semi-solid materials discussed earlier. Cushions having different cushioning materials or construction can also be stacked onto each other to provide a tailored durometer, flexibility, pliability and resilience to adapt to any mating irregularity at the region of user contact.

Figure 5:
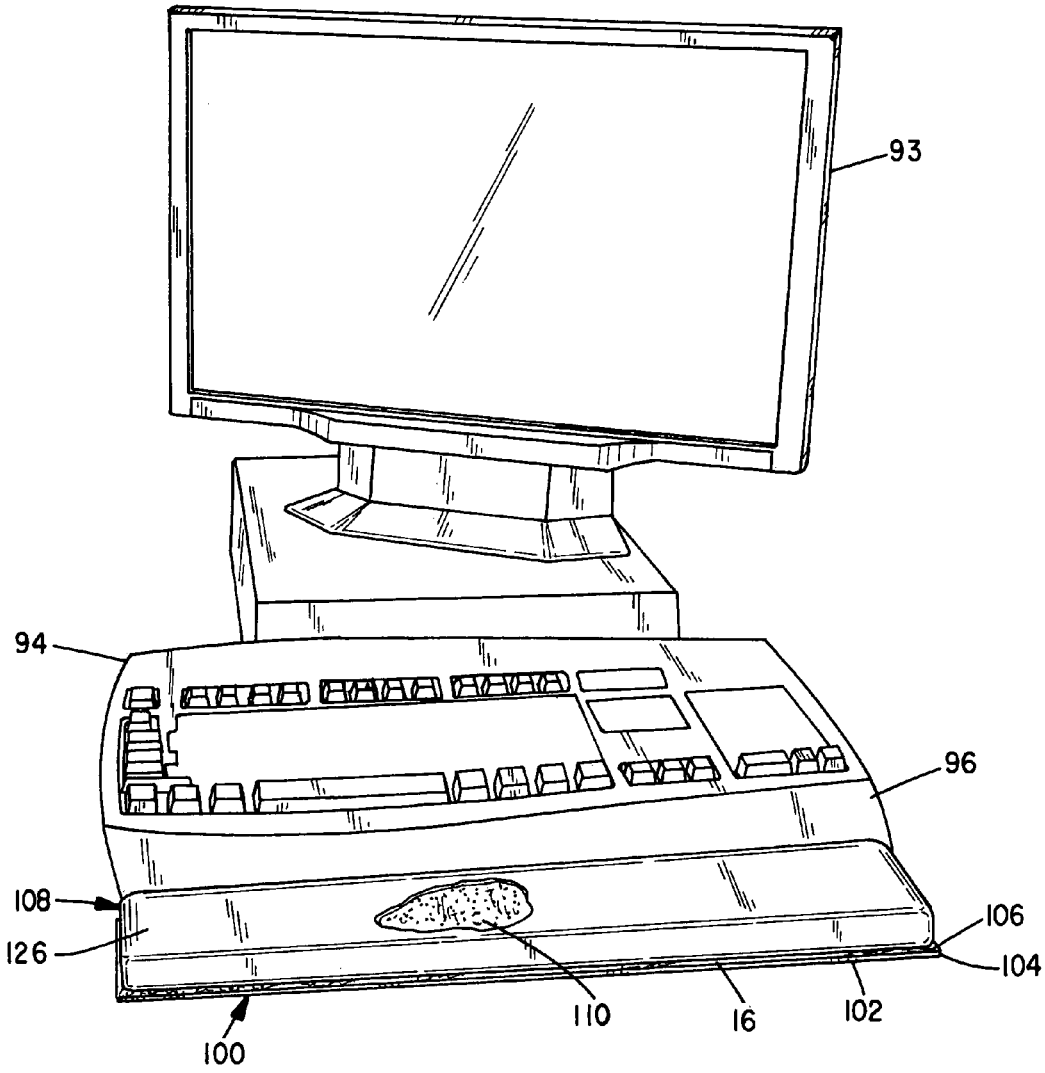
FIG. 5 is a perspective view to a typical computer work station and a desk mounted wrist or arm support cushion/pad.
Figure 6:
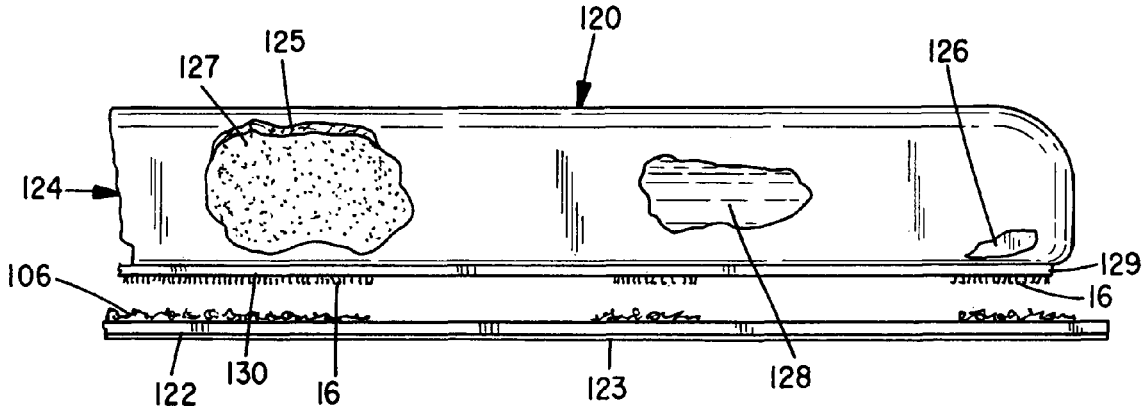
FIG. 6 is a cross section view to a detachable gel filled, foam wrist or arm support pad that can be used with the wrist/arm support pad of FIG. 5.

FIGS. 5 and 6 depict still other wrist/hand cushioning assemblies 100 and 120 that can be applied in an office setting. The cushioning assemblies 100 and 120 find application with a computer work station that typically has a monitor 93 and keyboard 94 that may already include a wrist support 96. The cushioning assemblies 100 and 120 are constructed to mount to a surface of the desk top of other hand, arm or wrist support surface adjacent the keyboard 94. The cushions 100 and 120 may also be mounted to the existing wrist support 96, but alone or in combination provide a relatively soft and smooth cushioning surface for a supported portion of the arm, wrist or hand.

The cushion assembly 100 provides a mat 102 having a base 104 that exhibits a low-slip, high grip strength or friction characteristic (e.g. rubber) that conforms and adheres to the desk top or keyboard support 96. An open weave fabric or looped material layer 106 covers the base layer 104. A contoured support cushion 108 mounts to the base layer 104 at a desired location on the mat 102 via a depending hook material fastener layer 16.

The cushion 108 is molded from a suitable elastomer or foam material 110 of preferred cushioning characteristic(s) that is covered and/or provides a laminated backer layer of an open weave fabric or a looped material 126. The shape, thickness, and three-dimensional contour of the cushion 108 can be varied as desired.

The cushion assembly 120 of FIG. 6 provides a mat 122 backed with an adhesive 123 that supports a layer of looped material 106. A cushion 124 attaches to the mat 122. The cushion 124 provides a foam or rubber outer envelope layer 125 that covers an inner firmer durometer cushioning material 126 and/or a semi-solid cushioning material 127 and/or a gel, liquid, air filled envelope 128. A substrate 129 having a depending hook material 16 is secured to the bottom of the cushion 124 and attaches to the open weave or looped material 106. It is to be appreciated the cushions 108 and 124 can exhibit other shapes and that the cushions 108 and 124 can be stacked onto each other or the keyboard support 96 or can be used in a variety of combinations with the keyboard 94 with or without the support 96.

Figure 7:
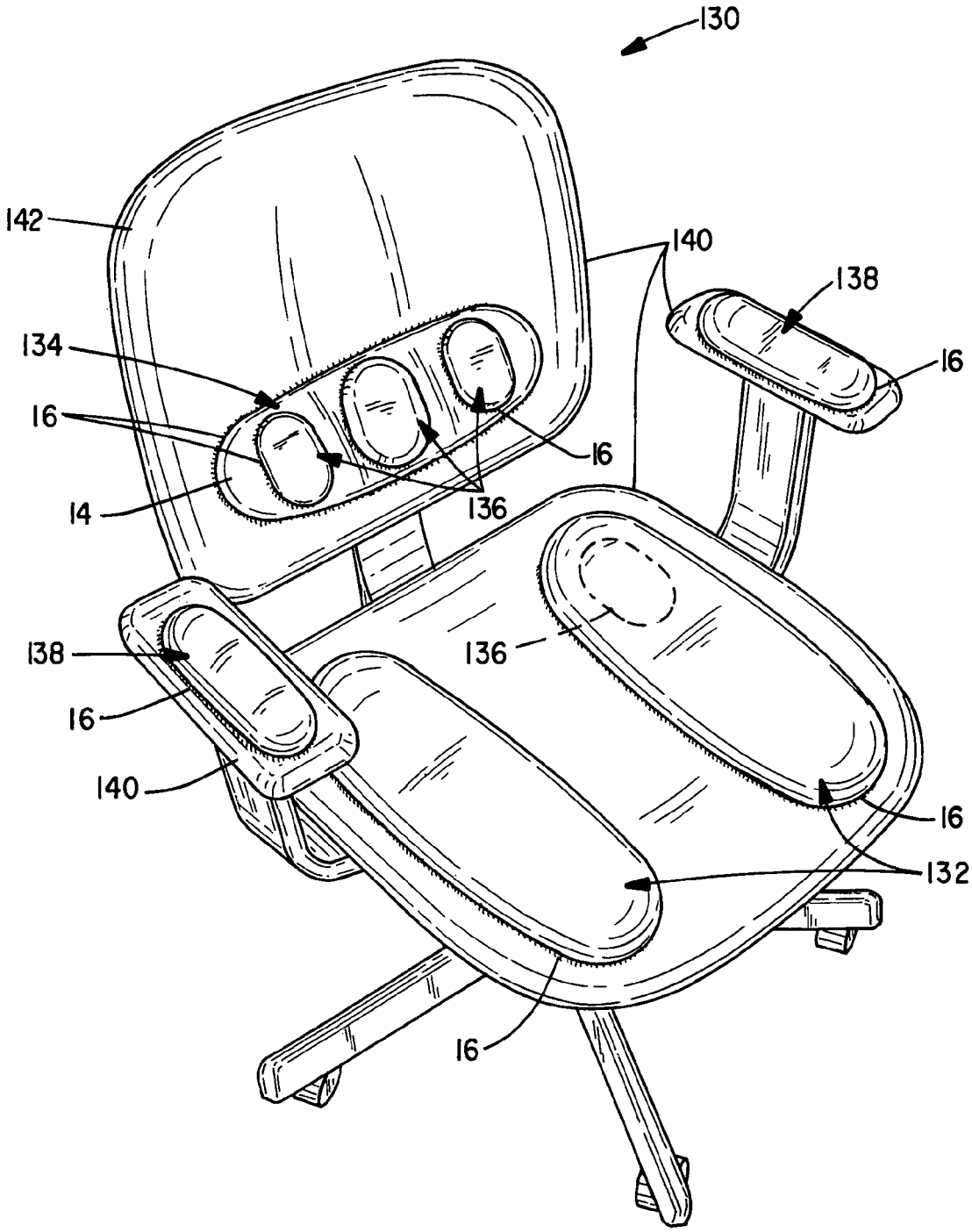
FIG. 7 is a perspective view to an office chair with several reconfigurable arm rest, lumbar and thigh support cushion/pad.

FIG. 7 depicts yet another office appliance and in particular an exemplary chair 130 that can be adapted to enhance a user's comfort with several attached cushion assemblies 132, 134, 136 and 138. Each of the cushion assemblies 132, 134, 136 and 138 are outfitted with regions of hook fastener material 16 that are positioned to adhere to the fabric surfaces 140 of the chair 130. The thigh support cushions 132, which can be combined into a single contoured cushion, are arranged to slightly elevate and ventilate the space beneath and around the thighs and crotch. The aft regions of the cushions 132 may be elevated slightly with a cushion 136 to better support the hips and buttocks.

The chair backrest 142 supports several stacked lumbar cushions 134 and 136. A hook fastener material layer 16 independently retains each cushion 134 and 136 to the fabric surface 140 of the chair 130 or to an open weave fabric cover or looped material 14 secured to the exposed surface of the cushions 134 and/or 136. The cushions 132, 134 and 136 can be constructed of cloth covered foam or rubber or as laminated foam/rubber and/or liquid, gel or fiber filled envelopes of preferred thicknesses and contours. The thickness and contour of the cushions 132, 134 and 136 are determined to permit modular arrangements that provide differing collective contours. The cushions 132, 134 and 136 can be tailor arranged to fit any particular user, depending upon the mounting arrangement of the cushion 134 to the backrest 142 and the cushions 136 on the cushion 134.

Figure 8:
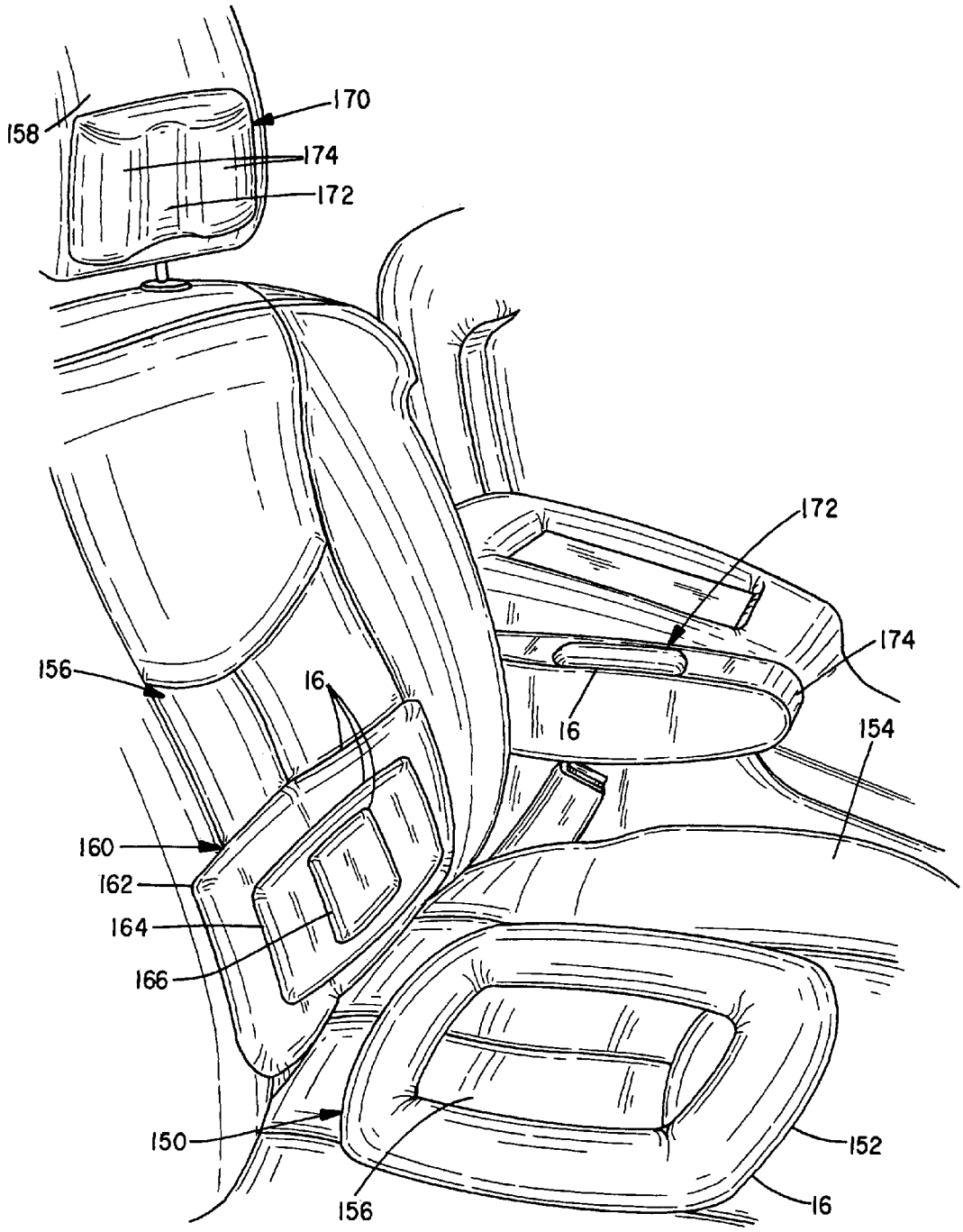
FIG. 8 is a perspective view to an automotive seat outfitted with several arm rest, lumbar and thigh support cushion/pad.

Still other seat or sacral, lumbar and head or neck rest cushion assemblies 150, 160 and 170 constructed for automotive applications are shown at FIG. 8. The seat or sacral support cushion assembly 150 provides an annular or ring-shaped, open weave fabric covered cushion 152. A hook fastener material 16 is secured to the bottom of the fabric cover material and is used to secure the cushion 150 to a fabric covered automotive seat 154. An open space 156 ventilates the user and the contour of the ring 152 is formed to support the thigh and buttocks at the seat 154.

The lumbar cushion assembly 160 is mounted to the seat backrest 156 and includes independently fitted cushions 162, 164 and 166. Each of the cushions 162, 164 and 166 include backing layers of hook fastener material 16 to provide an appropriate attachment to adjoining open weave fabric or loop fastener material surfaces at the interconnected cushions 162, 164 and 166. The cushions 162, 164 and 166 are stacked and located to support the lumbar region of the spine.

The neck or head rest cushion 170 is attached to the head rest 158. The contour of the cushion 170 provides a vertical recess 172 between adjacent raised vertical wings 174. An attached hook fastener material layer 16 secures the cushion 170 to either the back rest 156 or head rest 158. The undulating contour can thus be located to support either the head or neck and provide improved comfort to the user.

An arm rest cushion 172 backed with a hook material layer 16 is supported to an arm rest 174. The cushion 172 can be located to elevate the arm or support a user's wrist. One or more of the cushions 140, 150 or 170 may also include heating devices to further enhance user comfort. As with all the foregoing cushions, the cushions 140, 150, 170 or 172 can be constructed as padded, stuffed, laminated assemblies of foam, rubber or envelopes containing fibers, air, gel, liquid, or other semi-solid materials and coverings or combinations thereof to best fit the user. The cushions 150, 160, 170 and/or 172 can also be mounted alone or in combination to the compartment walls of the vehicle or other regions of the seat 154.

While the invention is shown and described with respect to several presently preferred constructions and several considered improvements, modifications and/or alternatives thereto, still other assemblies, arrangements and applications may be suggested to those skilled in the art. It is also to be appreciated that the singular features of the modular, detachable cushions can be arranged in different combinations and used with a variety of other appliances and devices having user contact surfaces. The cushions can also be detachably mounted to adjoining surfaces that a user might contact, such as walls, floors, operator cabs or the like, to provide for surfaces with tailored cushioning properties such as conformity, firmness, pliability, resilience and/or contour. The cushion(s) can include integral or attached hook type fastening material and cushion, pads, envelopes containing materials that can include among other materials, fiber padding, rubber, soft or low durometer rubbery material, elastomers, foams, air, gels, liquids and/or semi-solid materials, alone or in combination. The foregoing description should therefore be construed to include all those embodiments within the spirit and scope of the following claims.

What is claimed is:

1. A cushioning assembly comprising:

a) an appliance having contact surfaces that physically contact anatomical body surfaces of a user, which contact over time is susceptible of inducing user fatigue or abrasion, and wherein said contact surfaces are covered with an open weave or looped fabric material; and b) a cushion wherein a first cushion member comprises a layer of a foam, elastomer or rubber laminated to a layer of hook-type fastener material and further comprises a layer of an open weave or looped fabric material, and wherein a second cushion member is adapted to overlap and attach to the open weave or looped fabric material of said first cushion member to define a stacked contour, and wherein said hook-type fastener material of said first cushion member is detachably fastened to said open weave or looped fabric material at said contact surfaces to define a stacked conformal interface between the user and the appliance.

2. A cushioning assembly as set forth in claim 1 wherein one of said layers of said open weave or looped fabric material or said hook-type fastener material is integrally formed with the first cushion member.

3. A cushioned assembly comprising:

a) an external device having a plurality of contact surfaces that physically contact anatomical surfaces of a user, which contact over time is susceptible of inducing user fatigue or abrasion, and wherein said contact surfaces are covered with an open weave or looped fabric material; and b) a cushion assembly wherein a first cushion member comprises a first layer including an open weave or looped fabric material and a second layer including a hook-type fastener material, wherein a volume of air, liquid, gel, or a semi-solid resilient material is encapsulated between said first and second layers, wherein a second cushion member includes a surface containing a hook-type fastener material, and wherein the hook-type fastener material of said first and second cushions is attached to the open weave or looped fabric material of a contact surface or the other of the first and second cushioning members to define a stacked conformal interface between the user and the external device.

4. A cushioned assembly as set forth in claim 3 wherein said second cushion member comprises a layer of a foam, elastomer or rubber laminated to a layer of said hook-type fastener material.

5. A personal covering assembly for the feet, head, hands or other body parts comprising:

a) a cover piece having a plurality of contact surfaces that physically contact an anatomical surface of a user, which contact over time is susceptible of inducing user fatigue or abrasion, and wherein said contact surfaces are covered with an open weave or looped fabric material;

b) a cushion wherein a first cushion member comprises an envelope having a first layer including an open weave or looped fabric material and a second layer including a hook-type fastener material, wherein a volume of air, liquid, gel, or a semi-solid resilient material is encapsulated between said first and second layers, wherein a second cushion member includes a surface containing a hook-type fastener material, and wherein the hook-type fastener material of said first and second cushions is attached to the open weave or looped fabric material of a contact surface or the other of the first and second cushioning members to define a stacked conformal interface between the user and the cover piece.

6. A personal covering assembly as set forth in claim 5 wherein said second cushion member comprises a layer of a foam, elastomer or rubber laminated to a layer of said hook-type fastener material.

7. A cushioning assembly comprising:

a) an appliance having contact surfaces that physically contact anatomical body surfaces of a user, which contact over time is susceptible of inducing user fatigue or abrasion, and wherein said contact surfaces are covered with an open weave or looped fabric material; and b) a cushion wherein a first cushion member comprises an envelope defined by first and second layers mounted to encapsulate a volume of air, liquid, gelatinous, or semi-solid resilient material between said first and second layers, wherein said first cushion member comprises a layer of foam laminated to a hook-type fastener material and further comprises a layer of an open weave or looped fabric material, and wherein a second cushion member includes a layer of hook-type fastener material located to overlap and attach to the open weave or looped fabric material of said first cushion member or said appliance to define a stacked conformal interface between the user and the appliance.

8. A cushioning assembly as set forth in claim 7 wherein said second cushion member comprises an envelope defined by first and second liquid impermeable layers mounted to encapsulate a volume of air, liquid, gelatinous, or semi-solid resilient material.

9. A cushioning assembly as set forth in claim 7 wherein said second cushion member comprises a layer of a foam, elastomer or rubber and a layer of said hook-type fastener material.

10. A cushioning assembly as set forth in claim 7 wherein said appliance is selected from a class including armrests, chairs, footwear, gloves, headwear, keyboards, knee pads, seats, hand tools, wrist pads, or operator supports.

11. A cushioning assembly comprising:

a) an appliance having contact surfaces that physically contact anatomical body surfaces of a user, which contact over time is susceptible of inducing user fatigue or abrasion, and wherein said contact surfaces are covered with an open weave or looped fabric material; and b) a cushion wherein a first cushion member comprises an envelope defined by first and second layers mounted to encapsulate a volume of air, liquid, gel, or a semi-solid resilient material between said first and second layers, wherein said first layer includes an open weave or looped fabric material and said second layer includes a hook-type fastener material, and wherein a second cushion member includes a surface containing hook-type fastener material located to overlap and fasten to the open weave or looped fabric material of said contact surfaces or the first cushion member to define a stacked conformal interface between the user and the appliance.

* * * * *